US007028946B2

(12) United States Patent
Katsuhara et al.

(10) Patent No.: US 7,028,946 B2
(45) Date of Patent: Apr. 18, 2006

(54) EXPANDER ROLL

(75) Inventors: Kazuhiro Katsuhara, Osaka (JP); Yoshinobu Nakamura, Osaka (JP); Isao Origuchi, Osaka (JP)

(73) Assignee: Yamauchi Corporation, Hirakata (JP)

( * ) Notice: Subject to any disclaimer, the term of this patent is extended or adjusted under 35 U.S.C. 154(b) by 16 days.

(21) Appl. No.: 10/724,609

(22) Filed: Dec. 2, 2003

(65) Prior Publication Data

US 2004/0110616 A1 Jun. 10, 2004

(30) Foreign Application Priority Data

Dec. 5, 2002 (JP) ..... 2002-354124

(51) Int. Cl.
*B65H 23/04* (2006.01)

(52) U.S. Cl. ..... 242/615.2

(58) Field of Classification Search ..... 242/615.2; 492/16, 12, 39, 40; 26/101, 102, 103
See application file for complete search history.

(56) References Cited

U.S. PATENT DOCUMENTS 4,236,285 A 12/1980 Gallant
4,339,855 A * 7/1982 Demiere ..... 26/103
4,869,413 A * 9/1989 De Lucchi ..... 226/190
6,042,525 A * 3/2000 Rajaniemi ..... 492/39
2002/0077235 A1* 6/2002 Munsche et al. ..... 492/40

FOREIGN PATENT DOCUMENTS

JP 57-006122 1/1982

* cited by examiner

*Primary Examiner*—Kathy Matecki
*Assistant Examiner*—Sang Kim
(74) *Attorney, Agent, or Firm*—Stites & Harbison; Douglas E. Jackson

(57) ABSTRACT

An expander roll that has a plurality of metallic, cylindrical roll members is constructed to obtain sufficient liquidtightness, wherein a gap-facing concave portion 19 is formed in the outer circumferential surface of a ring-shaped elastic packing 17 with which a gap 18 between adjoining, cylindrical roll members 6A and 6B is closed, in addition, a required number of concave portions 21 are formed in both side parts of the gap-facing concave portion 19 so as to form pleat-like portions 22 and the outer circumferential surface of the pleat-like portion 22 is fixed to the inner circumferential surfaces of the cylindrical roll members 6A and 6B on the same side as the side of the outer circumferential surface of the pleat-like portion 22.

8 Claims, 9 Drawing Sheets

EXPANDER ROLL

BACKGROUND OF THE INVENTION

1. Field of the Invention

The present invention relates to an expander roll used to smooth out wrinkles in a sheet-like material, such as paper, cloth, or film, or used to tenter the sheet-like material.

2. Description of the Prior Art

For example, an expander roll in which a rubber-made roll body that is made slightly shorter than a curved shaft is attached to the outer periphery of the shaft with bearings therebetween or an expander roll in which a plurality of stainless-steel-made cylindrical roll members are attached to the outer periphery of a curved shaft with bearings therebetween is known as an expander roll used in a paper-manufacturing process.

In the former expander roll employing the rubber-made roll body, the rubber-made roll body is badly worn down because of friction with a sheet of pulp generated by its high-speed rotation, and high paper-manufacturing accuracy is hardly obtainable. Therefore, there are demands to widely use an expander roll employing the latter stainless-steel-made roll member that does not have these drawbacks not only in a dry part of the paper-manufacturing process but also in a wet part including a wire part and a press part.

Conventionally, an expander roll shown, for example, in FIG. 8 (Japanese Examined Patent Application Publication No. Sho-57-51573) is known as an expander roll employing the stainless-steel-made cylindrical roll member. In this expander roll, a plurality of roll elements 43 are successively attached to the outer periphery of a curved shaft 41 with a bearing 42, and the adjoining roll elements 43 are connected together through a connector 44, a buffer body 45, and a clutch pin 46. An O ring 48 fitted into a groove 47 formed in the outer periphery of the connector 44 prevents grease of the bearing 42 from leaking out to the outer circumferential surface of the roll.

However, when the plurality of roll elements 43 attached to the curved shaft 41 rotates at high speed, the adjoining roll elements 43 slightly recede from each other at a side corresponding to a direction in which the shaft 41 is curved, whereas the adjoining roll elements 43 slightly approach each other at the opposite side in the direction in which the shaft 41 is curved. Therefore, each roll element 43 repeatedly makes a reciprocating movement in the lengthwise direction of the shaft 41 in response to its high-speed rotation, and, as a result, the O ring 48 formed in the outer periphery of the connector 44 is swiftly worn away, and its liquidtightness is easily lost in a short time. Therefore, conventional problems lie in the fact that the risk of allowing the grease of the bearing 42 to leak out to the outer surface of the roll element 43 occurs with the lapse of time during which the expander roll is used and in the fact that water is infiltrated into the roll element 43 so as to cause breakdown of the bearing 42 when the expander roll is used in the wet part of the paper-manufacturing process.

Likewise, an expander roll shown, for example, in FIG. 9 (U.S. Pat. No. 4,236,285) is known as an expander roll employing the stainless-steel-made cylindrical roll member. In this expander roll, a plurality of spools (cylindrical roll members) 53 are successively attached to the outer periphery of a curved shaft 51 with a bearing 52, and a seal ring 55 is provided at both ends of a connection member 54 facing a gap between the adjoining spools 53 so as to obtain liquidtightness.

However, also in this expander roll, each spool 53 repeatedly makes a slight reciprocating movement in the lengthwise direction of the shaft 51 in response to the high-speed rotation of each spool 53, and the seal ring 55 is easily worn away in a short time. Therefore, the same problem as in the expander roll employing the O ring 48 has arisen.

It is therefore an object of the present invention to provide an expander roll that has a structure, in which a plurality of metallic roll members, such as stainless-steel-made roll members, are attached to the outer periphery of a curved shaft, capable of reliably obtaining liquidtightness even when it is rotated at high speed.

SUMMARY OF THE INVENTION

The present invention is characterized in that, in an expander roll in which a plurality of metallic, cylindrical roll members are attached to an outer periphery of a curved shaft with a bearing disposed between the roll members and the shaft, a ring-shaped elastic packing with which a gap between ends of adjoining, cylindrical roll members is closed is provided at the ends of the roll members, and outer surfaces of both side parts of a part of an outer circumferential surface of the ring-shaped elastic packing that faces the gap between the adjoining, cylindrical roll members are fixed to an inner surface of a cylindrical roll member, whereby the ring-shaped elastic packing is deformed in accordance with a movement in a lengthwise direction of the adjoining, cylindrical roll members.

Various metals, such as a stainless steel and an aluminum alloy, can be used as a material of the cylindrical roll member, in accordance with use conditions and other conditions of the expander roll.

Various elastic materials, such as silicone rubber, fluoro rubber, and foamed polyurethane in addition to NBR, SBR, and IR, can be used as a material of the ring-shaped elastic packing.

The present invention is also characterized in that, concerning the expander roll as set forth above, a gap-facing concave portion is formed in the part of the outer circumferential surface of the ring-shaped elastic packing that faces the gap between the adjoining, cylindrical roll members, and outer surfaces of both side parts of the gap-facing concave portion are fixed to inner surfaces, respectively, of the cylindrical roll members each of which is disposed on a side identical to a side of each side part of the outer surfaces, whereby both of the side parts of the gap-facing concave portion are deformed in accordance with a movement in a lengthwise direction of the adjoining, cylindrical roll members.

Various methods can be used as a means for fixing the outer surfaces of both side parts of the gap-facing concave portion to the inner surfaces of the cylindrical roll members, in addition to a method of using a sealing and bonding agent described later to fix them together. One example of the various methods is to form a concave portion in one of the outer surfaces of both the side parts of the gap-facing concave portion and the inner surfaces of the cylindrical roll members and form a convex portion in the other one so as to engage the concave and convex portions with each other.

Additionally, the width and the depth of the gap-facing concave portion are appropriately set so that both side parts thereof can easily follow the movement of the cylindrical roll members in the lengthwise direction.

The present invention is further characterized in that, concerning the expander roll as set forth above, one concave portion or a plurality of concave portions are formed in the outer surfaces of both side parts of the part of the outer circumferential surface of the ring-shaped elastic packing that faces the gap between the adjoining, cylindrical roll members, and both side parts of the part of the outer circumferential surface that faces the gap therebetween are formed like pleats, and outer surfaces of pleat-like portions and the inner surfaces of both the cylindrical roll members are fixed, whereby the pleat-like portions are deformed in accordance with the movement of the cylindrical roll members in the lengthwise direction.

In the present invention, the number of pleat-like portions is appropriately changed in accordance with a thickness of the ring-shaped elastic packing. Like the gap-facing concave portion, the width and the depth of the concave portion are appropriately set so that the pleat-like portions can easily follow the movement of the cylindrical roll members in the lengthwise direction.

The present invention is still further characterized in that, concerning the expander roll as set forth above, the pleat-like portion of each side part of the gap-facing part has its intermediate part between its base and its end, the intermediate part smaller in width than the base and the end.

The present invention is also technically characterized in that, concerning the expander roll as set above, a bottom corner part of the gap-facing concave portion or of another concave portion is formed like an arcuate concave.

In the present invention, since the bottom corner part of the concave portion is formed especially like an arcuate concave, stress in both side parts of the gap-facing concave portion or in the base of the pleat-like portion can be progressively dispersed.

The present invention is further technically characterized in that, concerning the expander roll as set forth above, a fixing operation between the outer surface of the ring-shaped elastic packing or the outer surface of its pleat-like portion and the inner surface of the cylindrical roll member is performed by use of a sealing and bonding agent that has both liquidtightness and bonding properties. A silicone-based liquid gasket, one-component RTV rubber, a silicone-based sealing agent, and an elastic epoxy adhesive can be mentioned as the sealing and bonding agent used in the present invention.

The present invention is still further technically characterized in that, concerning the expander roll as set forth above, a groove is formed in the outer circumferential surface of the pleat-like portion, and the sealing and bonding agent is poured into the groove.

The present invention is still further characterized in that, concerning the expander roll as set above, a likewise ring-shaped flange is provided at each end of the ring-shaped elastic packing; an edge of a sleeve extending in the lengthwise direction of the curved shaft is attached to an inner periphery of each flange; a closed-cell foamed ring is formed to be adjacent to both flanges; a cylindrical spacer and a cleat are provided on a side opposite to the flange of the foamed ring; and the cylindrical spacer and the flange are bonded to both sides of the foamed ring through the sealing and bonding agent.

In the present invention, since the foamed ring is interposed between the flange and the cylindrical spacer, it is possible to obtain liquidtightness and a buffering action when the cylindrical roll rotates around the outer periphery of the curved shaft at high speed.

According to the present invention, a ring-shaped elastic packing with which a gap between ends of adjoining, cylindrical roll members is closed is provided inside the ends of the roll members, a gap-facing concave portion facing a gap between the roll members that adjoin each other when necessary is formed in the outer circumferential surface of the ring-shaped elastic packing, and outer surfaces of both side parts of the gap-facing part or outer surfaces of both side parts of the gap-facing concave portion are fixed to inner surfaces, respectively, of the cylindrical roll members each of which is disposed on a side identical to a side of each side part of the outer surfaces, so that both of the side parts of the gap-facing part or both of the side parts of the gap-facing concave portion are deformed in accordance with a movement in a lengthwise direction of the adjoining, cylindrical roll members. Therefore, even when the plurality of cylindrical roll members on the curved shaft repeatedly make a slight reciprocating movement in the lengthwise direction of the roll members in response to its high-speed rotation, the outer circumferential surface of the ring-shaped elastic packing never causes friction with the inner circumferential surface of the cylindrical roll member, and therefore the outer periphery of the ring-shaped elastic packing is prevented from being worn away, and liquidtightness in the cylindrical roll member is reliably obtained over a long period of time.

Therefore, when the expander roll of the present invention is used in a paper-manufacturing process, the expander roll can be used in a wet part, such as a wire part or a press part, as well as in a dry part.

Additionally, as mentioned above, in the expander roll of the present invention, water is not infiltrated from the outside in the wet part, and foreign objects like dust are, of course, prevented from entering, and there is no fear that the grease of a bearing disposed in the cylindrical roll member will leak out of the cylindrical roll member and infiltrate into a pulp material.

Additionally according to the present invention, one concave portion or a plurality of concave portions are formed in the outer surfaces of both side parts of the part of the outer circumferential surface of the ring-shaped elastic packing that faces the gap between the adjoining, cylindrical roll members, and both side parts of the gap-facing part are formed like pleats. Therefore, even when the width of both side parts of the gap-facing part in the ring-shaped elastic packing is widened, both side parts formed like pleats can easily follow the movement of the cylindrical roll member, and water is prevented through some stages from infiltrating thereinto by being formed like pleats. Therefore, advantageously, liquidtightness in the cylindrical roll member is improved.

Further according to the present invention, the pleat-like portion of each side part of the gap-facing part has its intermediate part between its base and its end that is smaller in width than the base and the end. Therefore, it is possible to more easily follow the movement of the cylindrical roll member.

Still further according to the present invention, a bottom corner part of the gap-facing concave portion or of another concave portion is shaped like an arcuate concave. Therefore, when following both side parts of the gap-facing concave portion or its pleat-like portion, the stress of the base of these is dispersed. As a result, advantageously, physical fatigue in this part is restricted, and the form of the ring elastic packing is maintained over a long period of time.

Still further according to the present invention, a fixing operation between the outer surfaces of the pleat-like portions in both sides of the gap-facing part of the outer surface of the ring-shaped elastic packing and the inner surface of the cylindrical roll member is performed by use of a sealing and bonding agent that has both liquidtightness and bonding properties. Therefore, liquidtightness in the cylindrical roll member is further improved.

The present invention as particularly set forth has a structure in which a groove is formed in the outer circumferential surfaces of both side parts of the gap-facing part or in the outer circumferential surface of the pleat-like portion, and the sealing and bonding agent is poured into the groove so that the outer circumferential surfaces of both side parts of the gap-facing part or the outer circumferential surface of the pleat-like portion can be fixed to the inner circumferential surfaces of both cylindrical roll members. Therefore, integration between the outer surface of the ring-shaped elastic packing and the inner surface of the cylindrical roll member can be easily obtained, and water can be prevented, through some stages, from infiltrating, thereby ensuring the liquidtightness.

The present invention as additionally further set forth has a structure in which a similarly ring-shaped flange is provided at each end of the ring-shaped elastic packing; an edge of a sleeve extending in the lengthwise direction of the curved shaft is attached to an inner periphery of each flange; a closed-cell foamed ring is formed to be adjacent to both flanges; and a cylindrical spacer and a cleat are provided on a side opposite to the flange in the foamed ring. Therefore, the foamed ring is deformed in accordance with a slight movement in the lengthwise direction of the cylindrical roll members, and water is prevented from infiltrating also by this foamed ring. As a result, a double waterproof structure is obtained in cooperation with liquidtightness created by the ring-shaped elastic packing.

DESCRIPTION OF PREFERRED EMBODIMENTS

Next, with reference to the drawings, a description will be given of an embodiment in which the present invention has been applied to an expander roll for use in a paper-manufacturing process.

Figure 1:
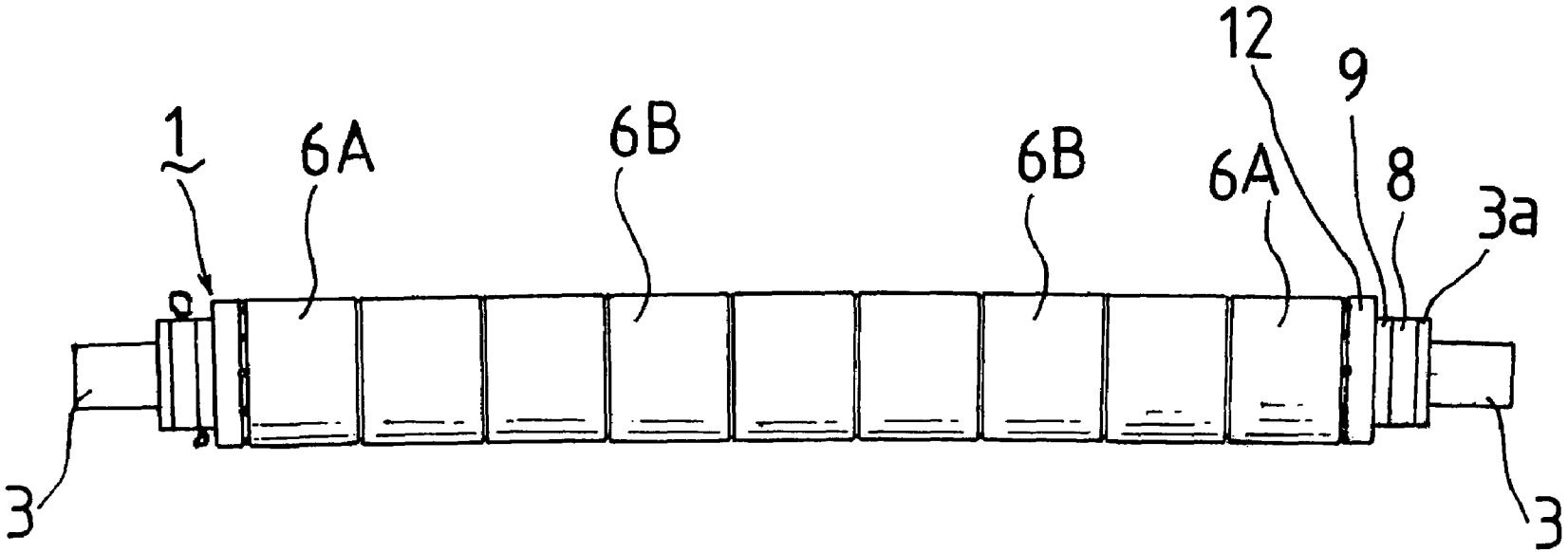
FIG. 1 is a front view that shows the entire expander roll in the embodiment of the present invention.
Figure 2:
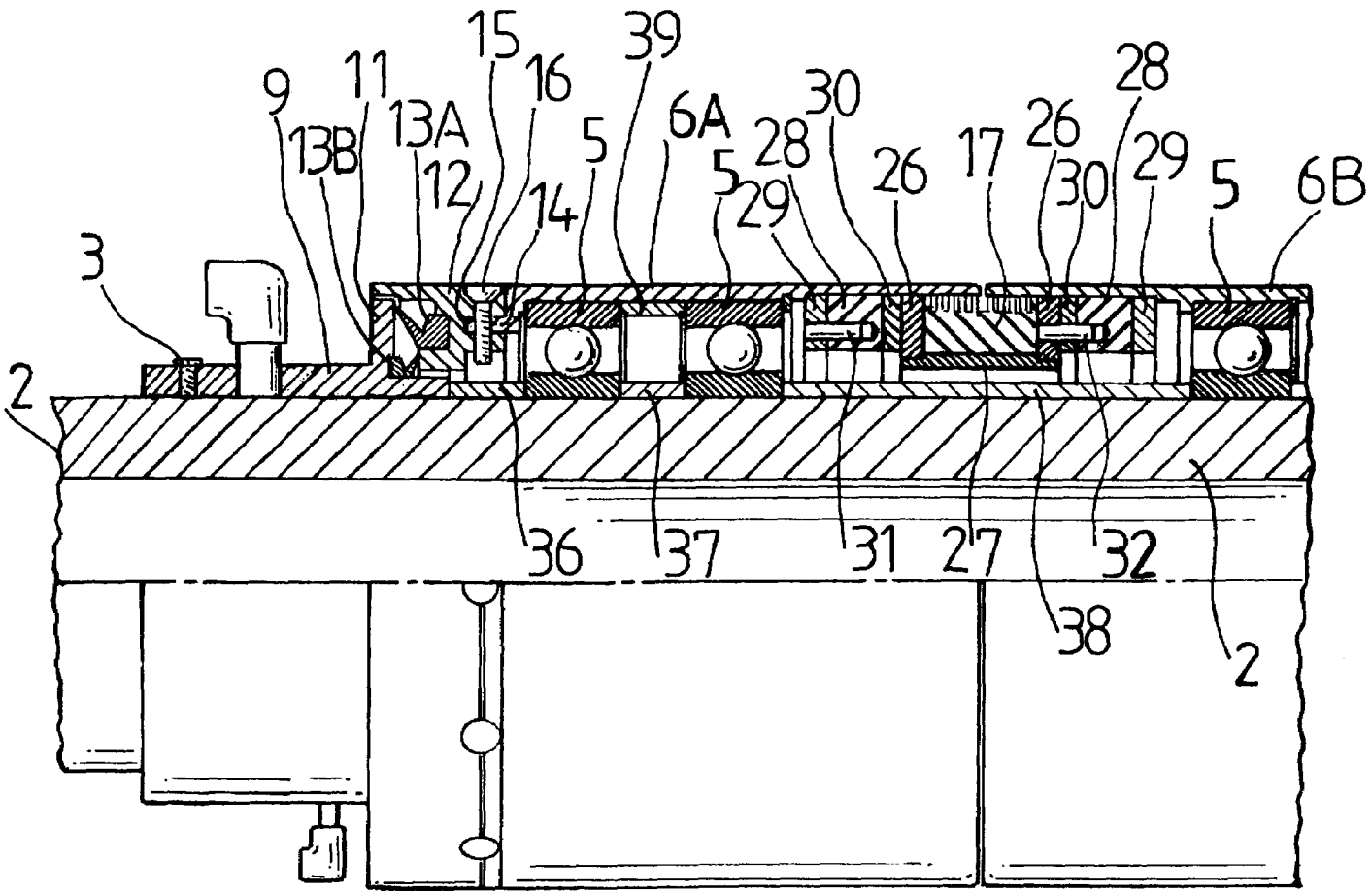
FIG. 2 is a partially cutaway front view that shows the internal structure of the expander roll in embodiment 1.

As shown in FIG. 1 and FIG. 2, an expander roll 1 in this embodiment includes a cylindrical, curved shaft 2 and a plurality of stainless-steel-made cylindrical roll members 6A and 6B rotatably attached to the outer periphery of a curved shaft 2 with bearings 5 therebetween.

An end seal 9 is attached to a part of the outer periphery of the curved shaft 2 close to an end of the curved shaft 2 through a screw 3. A seal cover 12 is provided so as to face a flange 11 protruding from the outer circumferential surface of the end seal 9. Substantially V-shaped, upper and lower seal rings 13A and 13B are fitted between the seal cover 12 and the flange 11.

The cylindrical roll member 6A is attached to a part of the outer periphery of the curved shaft 2 close to each end of the curved shaft 2. A reversed-L shaped portion 14 is formed at one of both ends of the cylindrical roll member 6A on the side of the seal cover 12. On the other hand, a fitting concave portion 15 into which the tip of the reversed-L shaped portion 14 is fitted is formed in the side face of the cylindrical roll member 6A in the seal cover 12. In a state in which the concave portion 15 and the reversed-L shaped portion 14 are engaged with each other, the cylindrical roll member 6A is connected to the seal cover 12 by inserting a screw 16 from the upper part of these.

Figure 3:
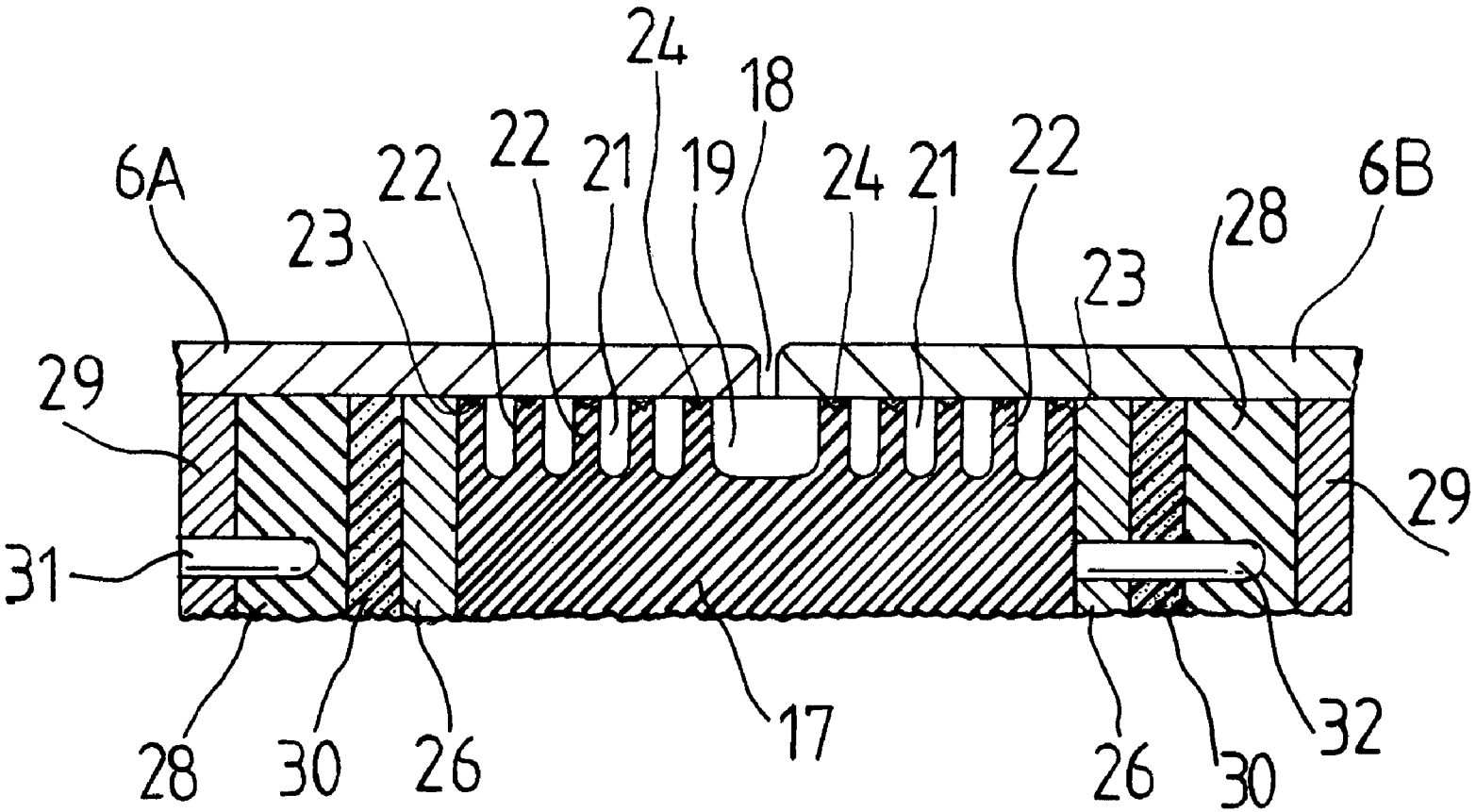
FIG. 3 is an enlarged sectional view that shows one example of a watertightness structure in this embodiment.

Next, as shown in FIG. 3, a description will be given of a watertightness structure of a gap 18 between ends of the cylindrical roll members 6A and 6B that adjoin each other. A rubber-made ring-shaped elastic packing 17 with which the gap 18 therebetween is closed is provided inside the ends of the adjoining, cylindrical roll members 6A and 6B. A gap-facing concave portion 19 that faces the gap 18 between the roll members 6A and 6B is formed in the outer circumferential surface of the ring-shaped elastic packing 17 over its circumference. A plurality of concave portions 21 are formed in the outer surfaces of both side parts of the gap-facing concave portion 19 in the ring-shaped elastic packing 17 over its circumference. Both side parts of the gap-facing concave portion 19 are formed to be a plurality of pleat-like portions 22.

A V-shaped groove 23 is formed in the outer circumferential surface of the pleat-like portion 22 over its circumference. The outer circumferential surface of the pleat-like portion 22 and the inner circumferential surfaces of the cylindrical roll members 6A and 6B are fixed together by pouring a sealing and bonding agent 24 that has both bonding properties and watertightness into the groove. As a result, as shown in FIG. 4 and FIG. 5, each pleat-like portion 22 is deformed in accordance with a movement of the adjoining, cylindrical roll members 6A and 6B in the lengthwise direction, and liquidtightness in the cylindrical roll members 6A and 6B is secured.

In this embodiment, a silicone-based liquid gasket is used as the sealing and bonding agent.

Figure 4:
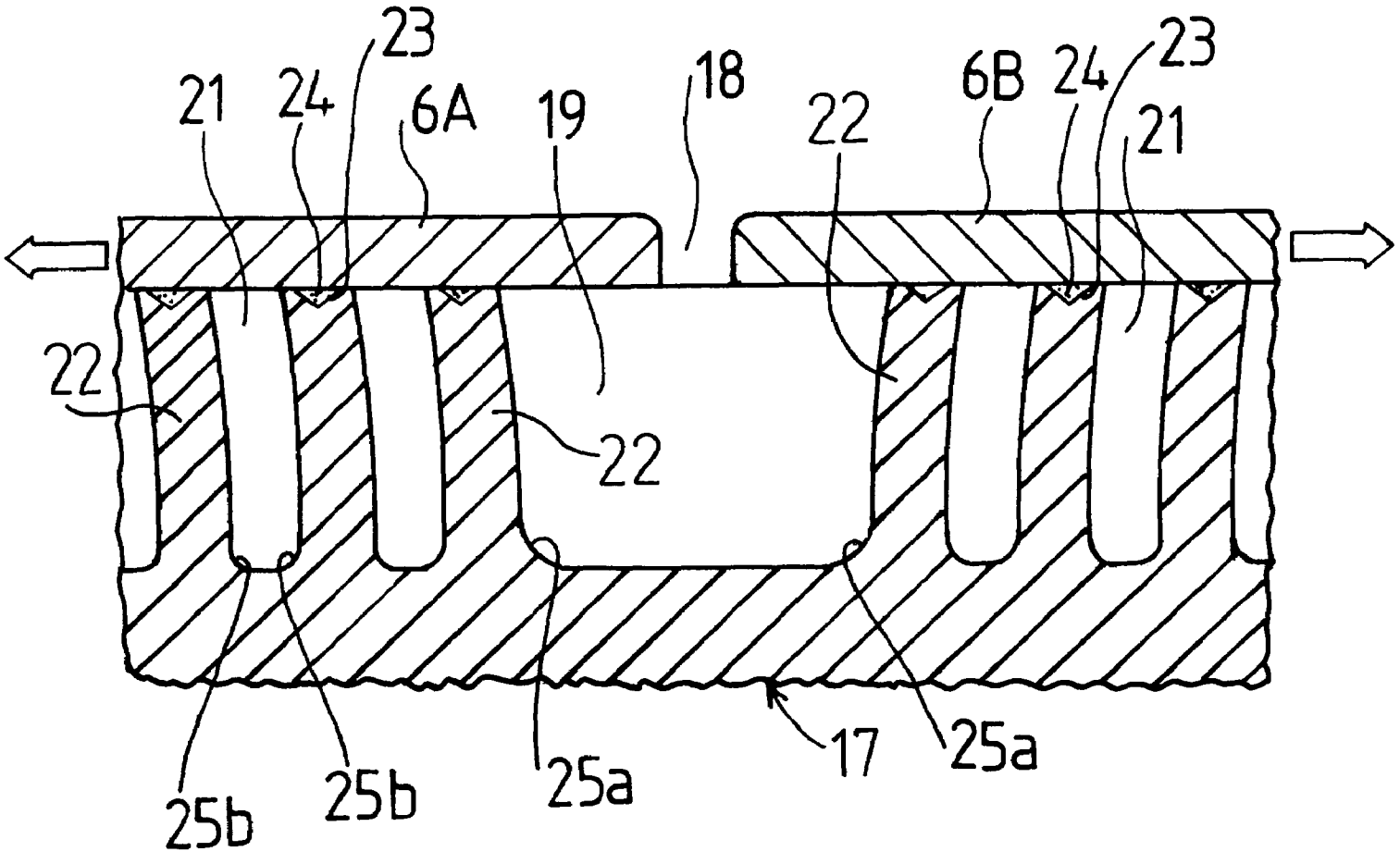
FIG. 4 is an enlarged sectional view that shows a state in which cylindrical roll members are situated apart from each other in this embodiment.

That is, when the cylindrical roll members 6A and 6B rotate at high speed, the adjoining, cylindrical roll members 6A and 6B recede from each other as shown in FIG. 4 so as to widen the gap 18 therebetween when the cylindrical roll members 6A and 6B are situated on the curved side of the curved shaft 2. The pleat-like portions 22 are also deformed so as to recede from each other in accordance with the cylindrical roll members 6A and 6B.

Figure 5:
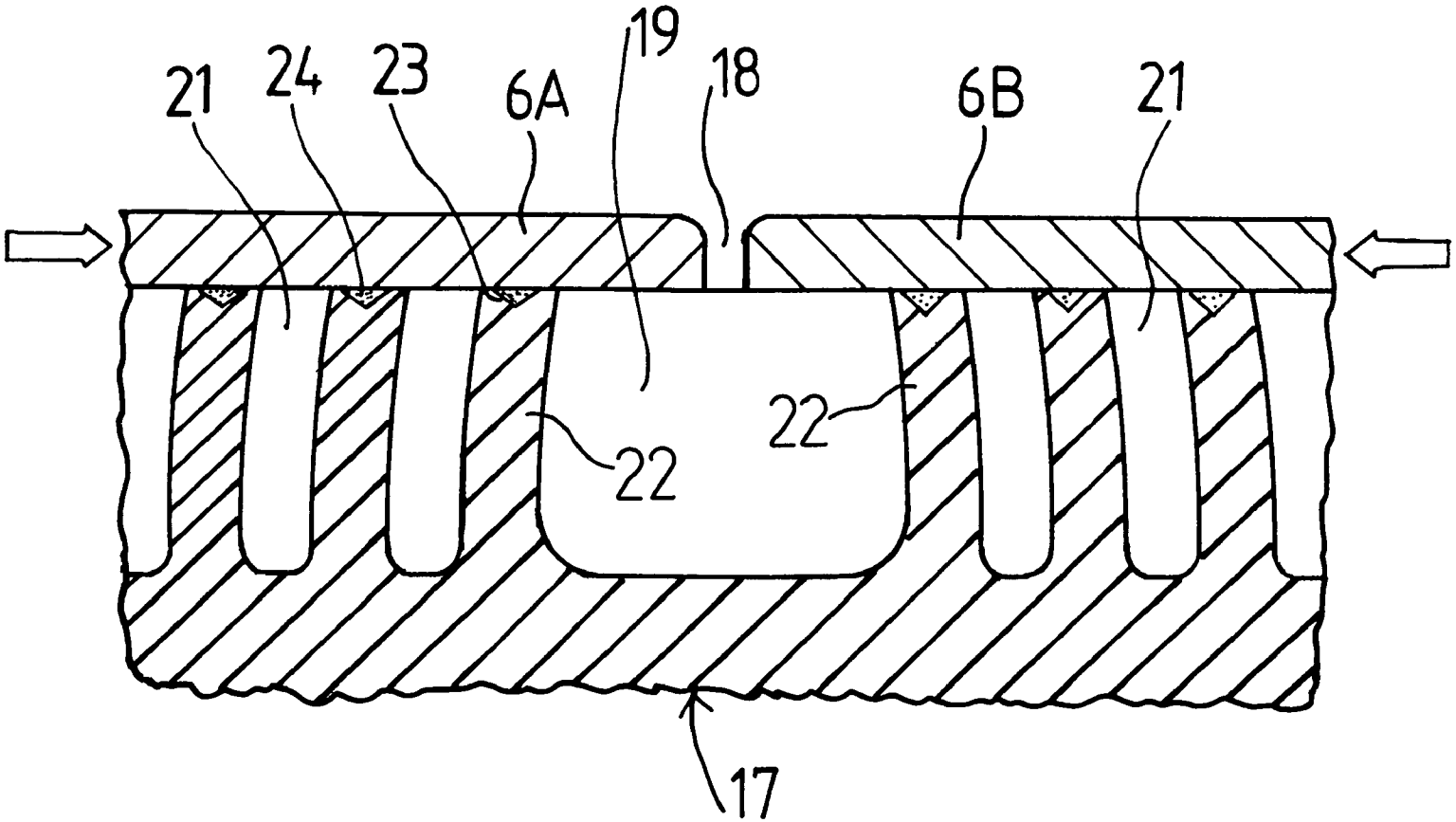
FIG. 5 is an enlarged sectional view that shows a state in which the cylindrical roll members are situated close to each other.

On the other hand, when the cylindrical roll members 6A and 6B are situated on the side opposite to the curved side of the curved shaft 2, the adjoining, cylindrical roll members 6A and 6B approach each other so as to narrow the gap 18 therebetween as shown in FIG. 5. The pleat-like portions 22 are also deformed in a direction in which they approach each other in accordance with the cylindrical roll members 6A and 6B.

In this embodiment, the gap-facing concave portion 19 has a wide width, and the other concave portions 21 are narrower in width than the gap-facing concave portion 19. However, the widths of these concave portions 19, 21 are appropriately changed in accordance with the thickness of the ring-shaped elastic packing 17. Moreover, bottom corner parts 25*a*, 25*b* of the gap-facing concave portion 19 and the other concave portions 21 are each formed like an arcuate concave.

As shown in FIG. 2 and FIG. 3, a similarly ring-shaped, stainless-steel-made flange 26 is provided at each end of the ring-shaped elastic packing 17. An end of a stainless-steel-made sleeve 27 that extends in the lengthwise direction of the curved shaft 2 is attached to the inner periphery of each flange 26.

The thickness of the ring-shaped elastic packing 17 is slightly greater than an interval between both the flanges 26, and the ring-shaped elastic packing 17 is fitted between the flanges 26.

A closed-cell polyurethane foamed ring 30 is provided adjacent to the flanges 26. The outer circumferential surface of the foamed ring 30 is bonded to the inner circumferential surfaces of the cylindrical roll members 6A and 6B with a sealing and bonding agent. A rubber-made cylindrical spacer 28 and a steel cleat 29 are provided on the side of the foamed ring 30 opposite to the flange 26.

Both side faces of the foamed ring 30 are bonded to the adjoining flange 26 and cylindrical spacer 28 with a sealing and bonding agent.

That is, in this embodiment, the flange 26, the foamed ring 30, the cylindrical spacer 28, and the cleat 29 are disposed at both sides of the ring-shaped elastic packing 17 with which the gap 18 between the adjoining, cylindrical roll members 6A and 6B is closed, between bearings 5 that rotatably support the adjoining, cylindrical roll members 6A and 6B, and these members at both sides of the ring-shaped elastic packing 17 are connected together through connecting pins 31 and 32.

In FIG. 2, 36 designates an intermediate collar that adjoins the end seal 9, 37 designates an end spool collar interposed between the adjoining bearings 5, 38 designates a spacer provided inside the ring-shaped elastic packing 17, and 39 designates an intermediate sleeve provided in the direction of the outer periphery of the end spool collar 37.

In this embodiment, the gap-facing concave portion 19 may be omitted.

Figure 6:
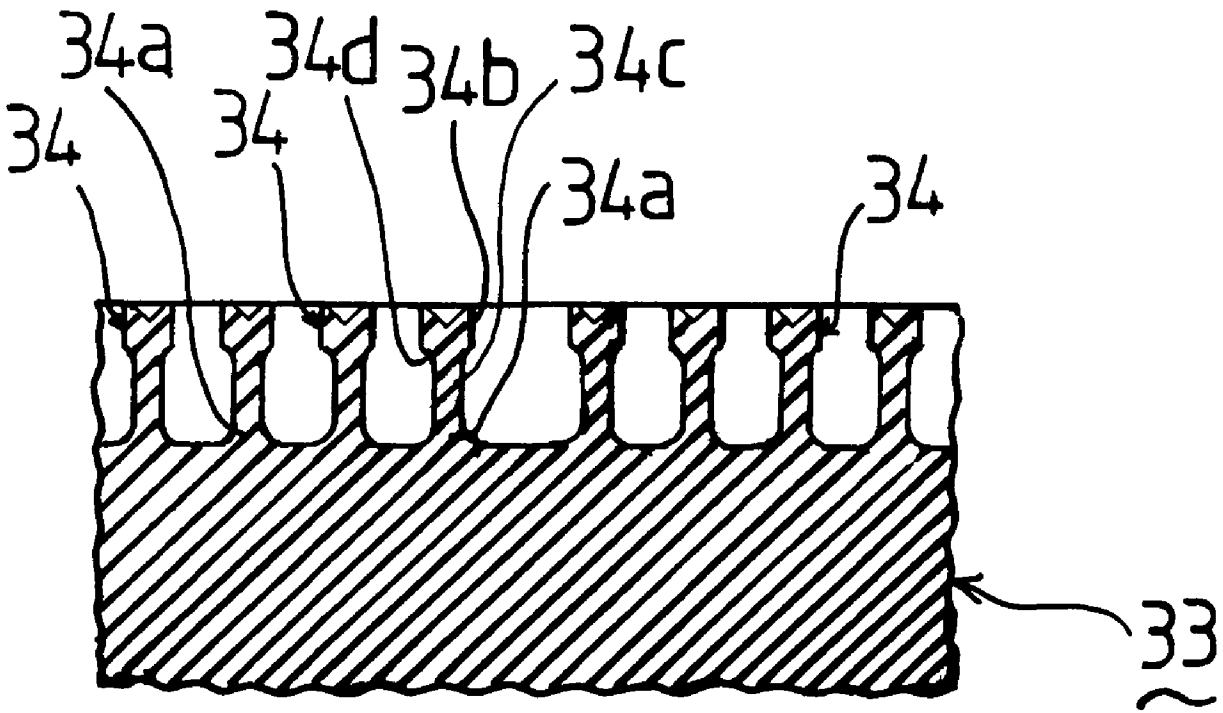
FIG. 6 is an enlarged sectional view that shows other embodiments of the pleat-like portion in a ring-shaped elastic packing.

FIG. 6 shows a modification of the aforementioned embodiment. Each pleat-like portion 22 in the ring-shaped elastic packing 17 has the same width from its base to its end in the aforementioned embodiment. However, in a ring-shaped elastic packing 33 in this embodiment, each pleat-like portion 34 has its intermediate part 34*c* between its base 34*a* and its end 34*b* that is slightly narrower in width than the base 34*a* and the end 34*b*, and has its part 34*d* between the end 34*b* and the intermediate part 34*c* that is shaped like an arcuate concave. Therefore, the pleat-like portion 34 can more easily follow movement of the cylindrical roll members 6A and 6B in the lengthwise direction than the pleat-like portion 22 in the aforementioned embodiment, and stress of the part 34*d* between the end 34*b* and the intermediate part 34*c* is dispersed when following it, thus making it possible to further restrain the physical fatigue of the part 34*d*.

Figure 7:
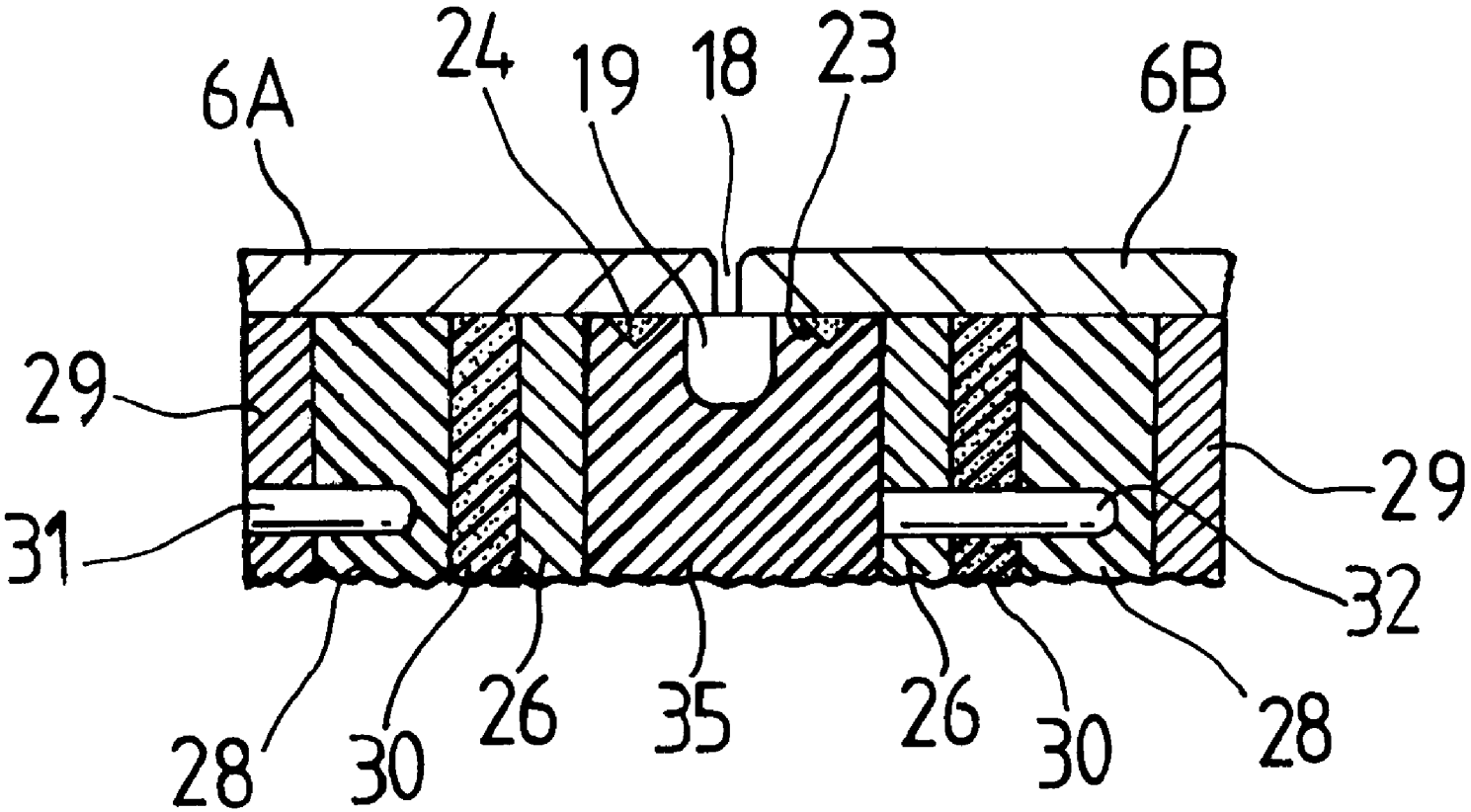
FIG. 7 is an enlarged sectional view that shows another embodiment of the ring-shaped elastic packing.
Figure 8:
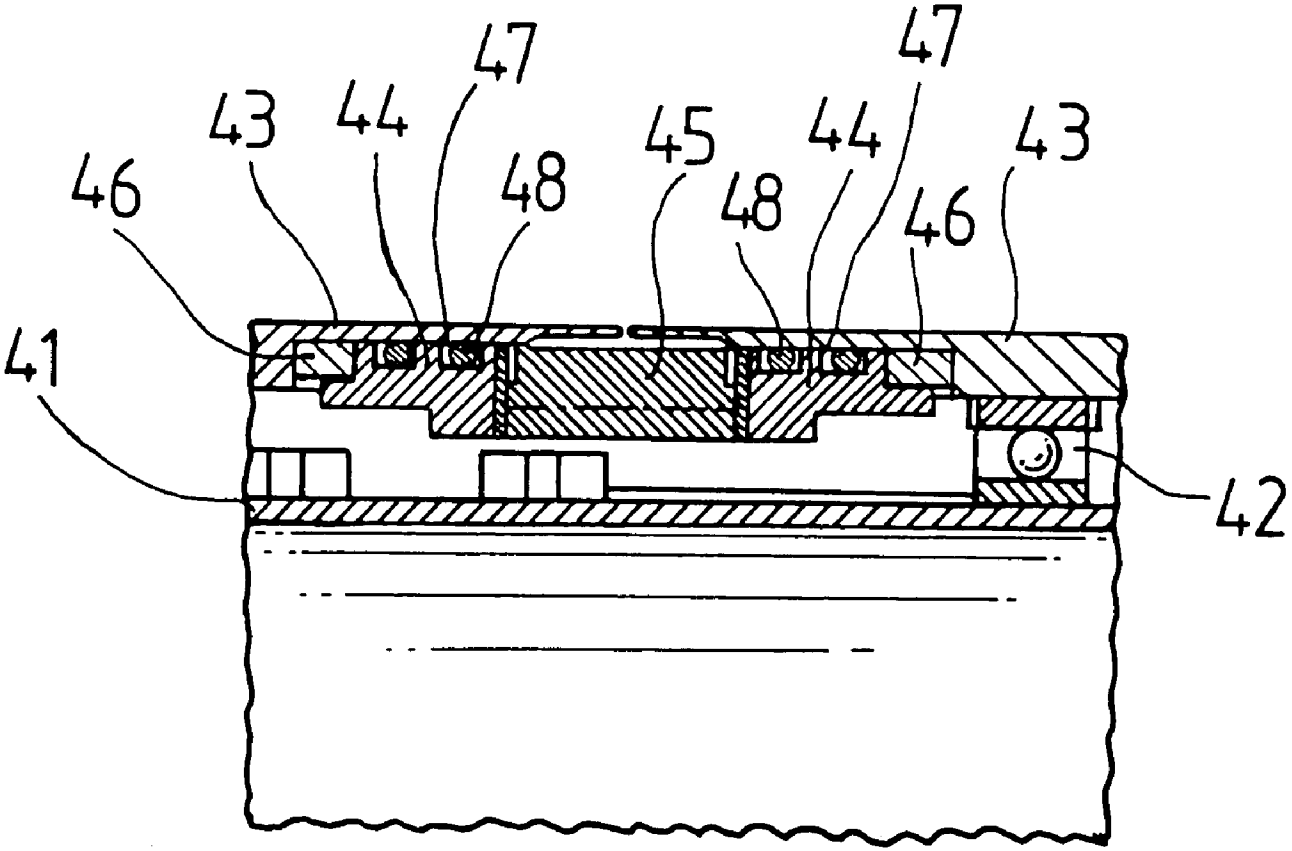
PRIOR ART FIG. 8
FIG. 8 is an enlarged sectional view that shows a conventional example.
Figure 9:
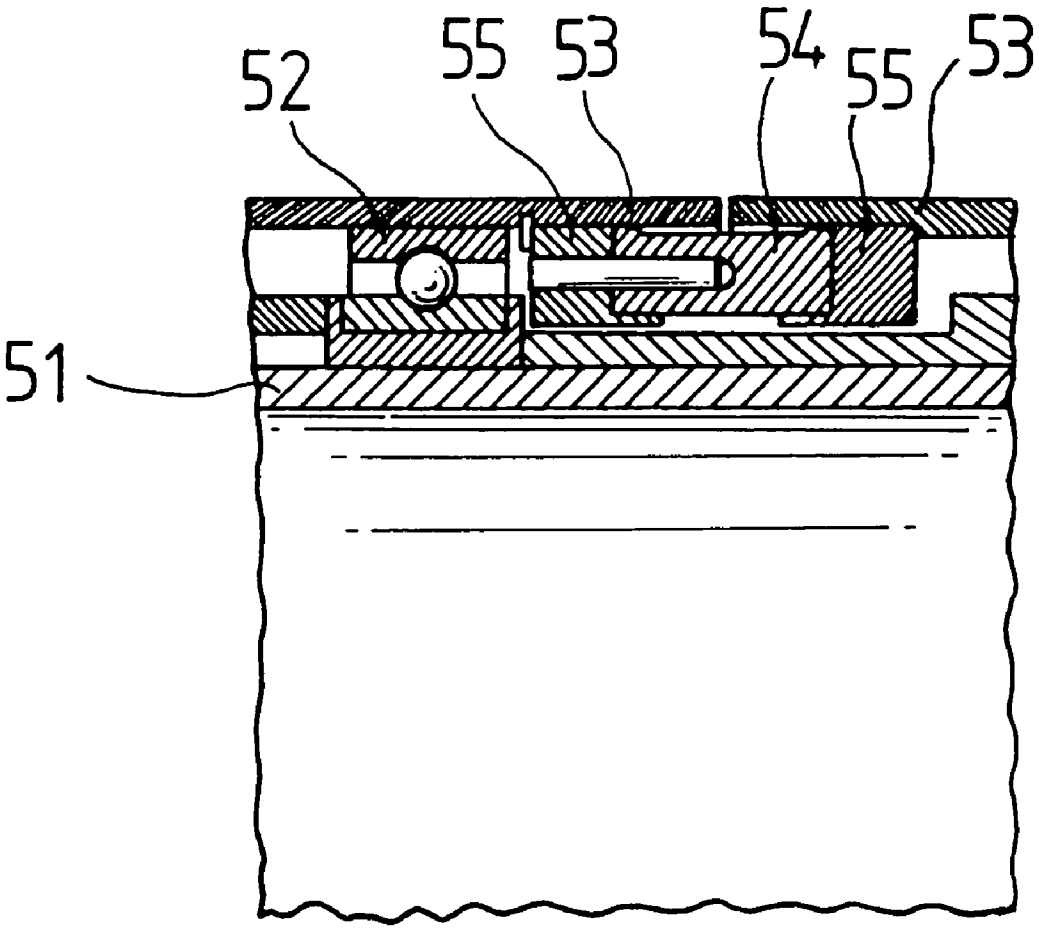
PRIOR ART FIG. 9
FIG. 9 is an enlarged sectional view that shows a conventional example.

FIG. 7 shows another modification of the aforementioned ring-shaped elastic packing 17. The ring-shaped elastic packing 17 has concave portions 21 differing from the gap-facing concave portion 19 in the outer surfaces of both side parts of the gap-facing concave portion 19, and the both side parts of the gap-facing concave portion 19 are formed to be a plurality of pleat-like portions 22. However, in a ring-shaped elastic packing 35 in this embodiment, both side parts of the gap-facing concave portion 19 are narrower in width than the ring-shaped elastic packing 17 in the aforementioned embodiment, and the concave portions 21 and the pleat-like portions 22 shown in the aforementioned embodiment are not provided. In this embodiment, the entire side parts of the gap-facing concave portion 19 follow the movement of the cylindrical roll members 6A and 6B in the lengthwise direction.

Since the structure of both side parts of the ring-shaped elastic packing 35 is identical to that in the aforementioned embodiment, the same reference characters as in the aforementioned embodiment are given, and a description thereof is omitted.

Moreover, in this embodiment, there maybe a case in which the ring-shaped elastic packing 35 is made of an elastic material, such as a closed-cell foamed elastic material, that is easily deformed, and the gap-facing concave portion 19 is omitted, so that both sides of the gap-facing part of the adjoining, cylindrical roll members 6A and 6B follow a movement of the cylindrical roll members 6A and 6B in the lengthwise direction.

What is claimed is:

1. An expander roll comprising:

a plurality of metallic, cylindrical roll members attached to an outer periphery of a curved shaft with bearings; and a ring-shaped elastic packing with which a gap between ends of adjoining, cylindrical roll members is closed, the packing provided inside the ends of the roll members and having an outer circumferential surface that faces the gap between the roll members which said outer circumferential surface has respective side parts on either side of the gap;

wherein outer surfaces of both side parts are fixed to inner surfaces of the cylindrical roll members, and the ring-shaped elastic packing is deformed in accordance with a movement in a lengthwise direction of the adjoining, cylindrical roll members; and wherein one concave portion or a plurality of concave portions are formed in the outer surfaces of both side parts so that both side parts have pleat-like portions, and outer surfaces of the pleat-like portions and the inner surfaces of both cylindrical roll members are fixed, whereby the pleat-like portions are deformed in accordance with the movement of the cylindrical roll members in the lengthwise direction.

2. The expander roll of claim 1, wherein a gap-facing concave portion in the outer circumferential surface of the ring-shaped elastic packing that faces the gap between the adjoining, cylindrical roll members serves to separate the side parts, and the outer surfaces of both side parts adjacent the gap-facing concave portion are fixed to inner surfaces, respectively, of the cylindrical roll members each of which is disposed on a side identical to a side of each side part of the outer surfaces, whereby both of the side parts adjacent the gap-facing concave portion are deformed in accordance with a movement in a lengthwise direction of the adjoining, cylindrical roll members.

3. The expander roll of claim 1, wherein the pleat-like portion of each side part of the gap-facing part has its intermediate part between its base and its end, the intermediate part smaller in width than the base and the end.

4. The expander roll of claim 1, wherein a bottom corner part of the gap-facing concave portion or of another concave portion is shaped like an arcuate concave.

5. The expander roll of claim 1, wherein a fixing operation between the outer surfaces of the pleat-like portions in both sides of the gap-facing part of the outer surface of the ring-shaped elastic packing and the inner surface of the cylindrical roll member is performed by use of a sealing and bonding agent that has both liquidtightness and bonding properties.

6. The expander roll of claim 5, wherein a groove is formed in the outer circumferential surface in the pleat-like portions, and the sealing and bonding agent is poured into the grooves.

7. The expander roll of claim 1, wherein a similarly ring-shaped flange is provided at each end of the ring-shaped elastic packing; an edge of a sleeve extending in the lengthwise direction of the curved shaft is attached to an inner periphery of each flange; a closed-cell foamed ring is formed to be adjacent to both the flanges; a cylindrical spacer and a cleat are provided on a side opposite to the flange in the foamed ring; and the cylindrical spacer and the flange are bonded to both side faces of the foamed ring with a sealing and bonding agent.

8. An expander roll comprising:

a plurality of metallic, cylindrical roll members attached to an outer periphery of a curved shaft with bearings; and a ring-shaped elastic packing with which a gap between ends of adjoining, cylindrical roll members is closed, the packing provided inside the ends of the roll members;

wherein outer surfaces of both side parts of a part of an outer circumferential surface of the ring-shaped elastic packing that faces the gap between the roll members are fixed to inner surfaces of the cylindrical roll members, and the ring-shaped elastic packing is deformed in accordance with a movement in a lengthwise direction of the adjoining, cylindrical roll members; and wherein a similarly ring-shaped flange is provided at each end of the ring-shaped elastic packing; an edge of a sleeve extending in the lengthwise direction of the curved shaft is attached to an inner periphery of each flange; a closed-cell foamed ring is formed to be adjacent to both the flanges; a cylindrical spacer and a cleat are provided on a side opposite to the flange in the foamed ring; and the cylindrical spacer and the flange are bonded to both side faces of the foamed ring with a sealing and bonding agent.

* * * * *